US008863830B2

(12) United States Patent
Varkey et al.

(10) Patent No.: US 8,863,830 B2
(45) Date of Patent: Oct. 21, 2014

(54) PRESSURE CONTROL DEVICE FOR WIRELINE CABLES AND METHOD

(75) Inventors: Joseph Varkey, Sugar Land, TX (US); Vadim Protasov, Sugar Land, TX (US); Jushik Yun, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 303 days.

(21) Appl. No.: 12/723,120

(22) Filed: Mar. 12, 2010

(65) Prior Publication Data

US 2010/0258323 A1 Oct. 14, 2010

Related U.S. Application Data

(60) Provisional application No. 61/160,086, filed on Mar. 13, 2009.

(51) Int. Cl.
*E21B 33/072* (2006.01)
*E21B 33/068* (2006.01)

(52) U.S. Cl.
CPC ..... *E21B 33/068* (2013.01)
USPC ..... 166/77.1; 166/86.1

(58) Field of Classification Search
CPC ..... E21B 17/025; E21B 33/03; H02G 15/06
USPC ..... 166/77.1, 86.1, 368, 385, 53, 66, 70, 82
See application file for complete search history.

(56) References Cited

U.S. PATENT DOCUMENTS

| | | | | |
|---|---|---|---|---|
| 2,555,145 | A * | 5/1951 | McKinney | 254/29 R |
| 2,670,225 | A * | 2/1954 | McKinney | 277/324 |
| 3,145,995 | A | 8/1964 | Adamson et al. | |
| 4,137,762 | A * | 2/1979 | Smith | 73/152.54 |
| 4,577,873 | A * | 3/1986 | Baumann | 277/520 |
| 5,615,896 | A * | 4/1997 | Morvant | 277/530 |
| 5,865,245 | A * | 2/1999 | Trout et al. | 166/84.2 |
| 7,170,007 | B2 | 1/2007 | Varkey et al. | |
| 2007/0107928 | A1 * | 5/2007 | Varkey et al. | 174/102 R |

FOREIGN PATENT DOCUMENTS

| | | |
|---|---|---|
| EP | 2009226 A2 | 12/2008 |
| WO | 2005049956 A2 | 6/2005 |

* cited by examiner

*Primary Examiner* — Cathleen Hutchins
*Assistant Examiner* — Ronald Runyan
(74) *Attorney, Agent, or Firm* — Trevor Grove

(57) ABSTRACT

An embodiment of a pressure control assembly for a wireline cable disposed in a wellbore comprises a housing frame, at least a pair of sealing devices disposed in the housing, the sealing devices defining an aperture for a cable to pass therethrough and a chamber therebetween, and a lubricant recirculation system for injecting and recirculating a lubricant into the chamber, the assembly operable to lubricate the cable and seal the cable, and maintain a predetermined pressure within the housing frame while the cable is disposed therein.

8 Claims, 6 Drawing Sheets

PRESSURE CONTROL DEVICE FOR WIRELINE CABLES AND METHOD

CROSS REFERENCE TO RELATED APPLICATIONS

This application claims priority under 35 U.S.C. §119(e) to U.S. Provisional Application Ser. No. 61/160,086, entitled Pressure Control Device for Wireline Cables filed on Mar. 13, 2009, the disclosure of which is incorporated herein by reference in its entirety.

FIELD

The present disclosure relates generally to wellsite surface equipment and wireline cables.

BACKGROUND

The statements in this section merely provide background information related to the present disclosure and may not constitute prior art The present disclosure is related in general to wellsite surface equipment such as wireline surface equipment and the like. When using downhole cables, such as wireline cables, in high-pressure wellbores, measures must be taken to prevent release of that pressure when running cable in and out of the wellbore.

Wellhead pressure is typically controlled by passing the cable 12 run from a wireline truck 13 or the like through a combination of pulleys, masts, and/or risers, (not shown), one or more elongated grease tubes or flow tubes 14, and a packoff assembly or "stuffing box" (not shown). As the well pressure from the wellbore 10 enters the flow tubes 14, grease is injected at a location 16 near the bottom of the tube 14 at a pressure greater than a measured well pressure. The grease then exits a top portion of the tube 14 and is discarded. In the packoff assembly is tightened down by hydraulic means or the like onto a rubber gasket, which causes the gasket to squeeze onto and seal against the wireline cable. The packoff assembly provides a static seal against a conventional wireline cable. When raising or lowering the cable, contact between the cable 12 and the sealing surface may cause the cable's outer armor wires to saw against the seal's rubber surface.

The drawbacks of the flow tubes 14 are related primarily to the tight tolerances (about 0.003 to about 0.005 inches) required between the interior of the tubes 14 and the exterior of the wireline cables 12. At these tight tolerances, armor wires raised up above the cable 12 profile can lead to armor crossover, armor wire milking (wherein a raised armor is pushed down the cable 12), and bird caging (wherein several raised armor wires become tangled above the cable profile). Sand and rocks from the wellbore may also become embedded between the armor wires and further exacerbate these problems. In addition, because these grease tubes or flow tubes 14 are disadvantageously placed above the lubricators and other pressure control equipment at a relatively inaccessible location high above the well floor that may only be reached by the use of personnel baskets or the like. Furthermore, traditional wireline cables 12 may have uneven profiles and slight inconsistencies in outside diameter, which require higher flow tube 14 tolerances, which causes inefficient sealing and great use of grease. Flow tubes 14 used in sealing the cable 12 at the wellhead must be chosen based on the largest outside diameter, creating a weaker seal when the diameter is at its smallest dimension.

In another pressure-sealing strategy, smooth-profile cables 20 (see FIGS. 3 and 4) are used in conjunction with rubberized cylindrical packers or wipers 22, which are sized to fit tightly over the cable 20 rather than the long lengths of grease tubes or flow tubes 14. The packers 22, however, may become damaged with prolonged use, especially on the tapered ends thereof (see FIG. 4).

It remains desirable to provide improvements in wellsite surface equipment in efficiency, flexibility, reliability, and maintainability.

SUMMARY

An embodiment of a pressure control assembly for a wireline cable disposed in a wellbore comprises a housing frame, at least a pair of sealing devices disposed in the housing, the sealing devices defining an aperture for a cable to pass therethrough and a chamber therebetween, and a lubricant recirculation system for injecting and recirculating a lubricant into the chamber, the assembly operable to lubricate the cable and seal the cable, and maintain a predetermined pressure within the housing frame while the cable is disposed therein. In an embodiment, the assembly further comprising at least two housing frames each defining a chamber arranged in series at the wellbore. In an embodiment, the assembly further comprising at least one actuator to activate the sealing devices to engage with an exterior surface of the cable. In an embodiment, the lubricant comprises a grease.

In an embodiment, the cable comprises a wireline cable comprising an outer polymeric layer encasing the cable to form a smooth outer profile. In an embodiment, the cable comprises a wireline cable comprising an inner and outer armor wire layer and a polymeric layer encasing the inner armor wire layer. In an embodiment, at least one of the sealing devices comprises an interior chevron-shaped profile. In an embodiment, at least one of the sealing devices comprises an interior graduated chevron inner profile wiper. In an embodiment, at least one of the sealing devices comprises a reinforcement member disposed therein. In an embodiment, the assembly is attached to surface equipment at a wellsite.

An embodiment of a method for sealing a wellbore cable at a surface of a wellbore comprises providing a housing frame having at least a pair of sealing devices disposed therein and defining an aperture for a cable to pass therethrough and a chamber therebetween, providing a lubricant system for injecting a lubricant into the chamber, introducing a wireline cable into the assembly and into a wellbore, and injecting a lubricant into the chamber, the assembly lubricating and sealing the cable, and maintaining a predetermined pressure within the housing frame while the cable is disposed therein. In an embodiment, providing a lubricant system comprises providing a lubricant recirculation system for injecting and recirculating a lubricant into the chamber and injecting may further comprises recirculating the lubricant into the chamber. In an embodiment, the method further comprises providing at least one actuator to activate the sealing devices to engage with an exterior surface of the cable. In an embodiment, injecting a lubricant comprises injecting a grease.

In an embodiment, introducing a wireline cable comprises introducing a wireline cable comprising an outer polymeric layer encasing the cable to form a smooth outer profile. In an embodiment, introducing a wireline cable comprises introducing a wireline cable comprising an inner and outer armor wire layer and a polymeric layer encasing the inner armor wire layer.

In an embodiment, providing a housing frame comprises providing at least one sealing device comprising an interior chevron-shaped profile. In an embodiment, providing a housing frame comprises providing at least one sealing device comprising an interior graduated chevron inner profile wiper. In an embodiment, providing a housing frame comprises providing at least one sealing device comprising a reinforcement member disposed therein. In an embodiment, the method further comprises attaching the assembly to surface equipment at a wellsite.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
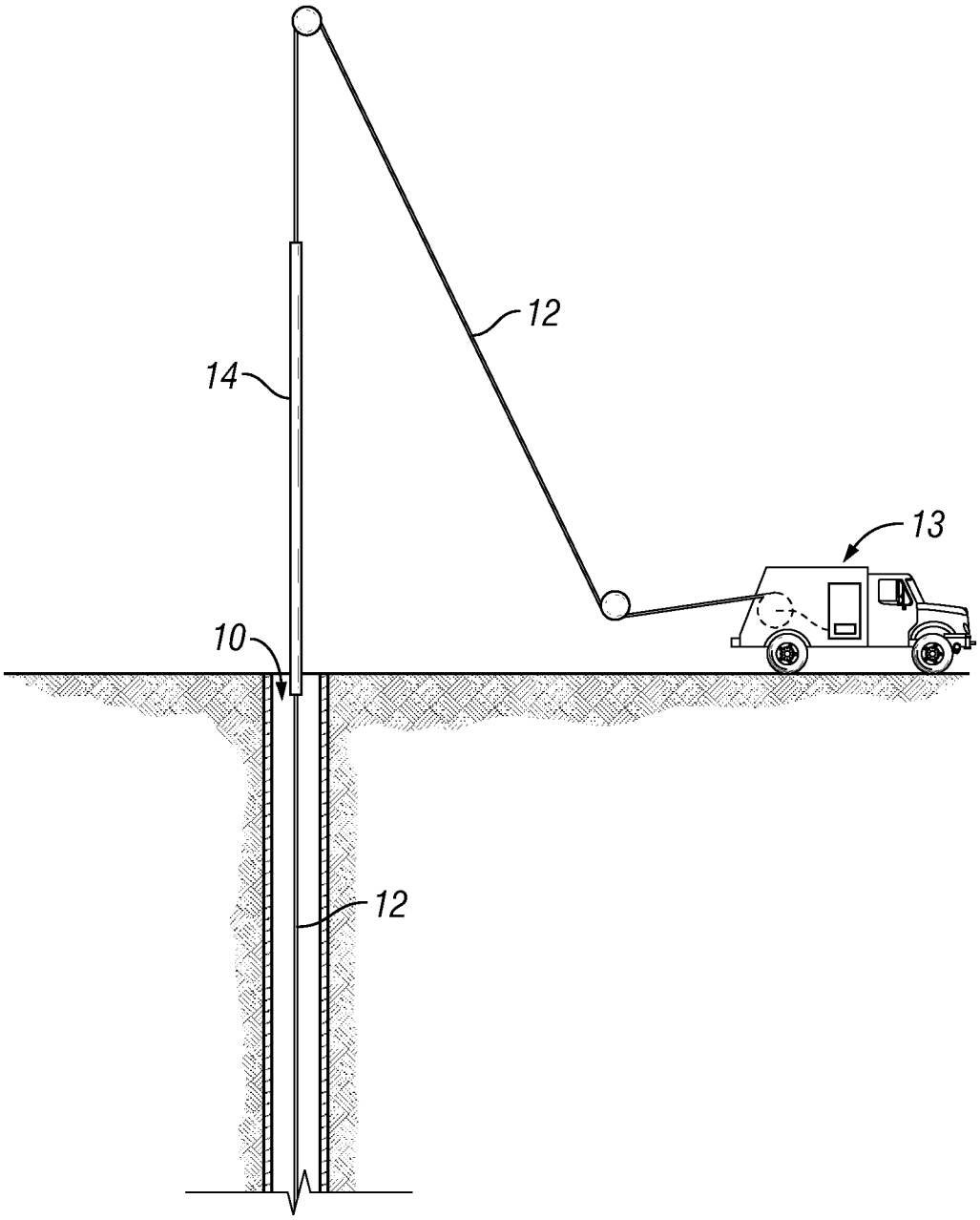
FIG. 1 (Prior Art)
FIGS. 1-4 are schematic views, respectively, of prior art pressure control equipment.

Referring now to FIGS. 5-8, an embodiment of a pressure control assembly for sealing a wireline cable 102 being lowered into a wellbore, such as the wellbore 10 is indicated generally at 100. The assembly 100 comprises a housing frame 106 defining a pathway for the cable 102 to pass therethrough. A pair of sealing devices or line wipers 108 is disposed in the housing 106. The line wipers 108 are operable to seal the cable 102 along a plurality of axes, such as in an axial and lateral direction, while the cable 102 passes through the housing 106 and line wipers 108, discussed in more detail below. The line wipers 108 are preferably formed from an elastomeric material such as, but not limited to, rubber or the like, discussed in more detail below and may define an aperture 110 therein to allow the cable 102 to pass therethrough while also sealing against an exterior surface of the cable 102. The housing 106 and the line wipers 108 defines a chamber 112 therebetween. The assembly 100 may be attached to surface pressure control equipment 107 at a wellsite surface 109. The surface equipment 107 may comprise a riser, a blow out preventer (BOP) stack, a riser, an equalizing block, or other suitable wellsite surface equipment, as will be appreciated by those skilled in the art.

Figure 5:
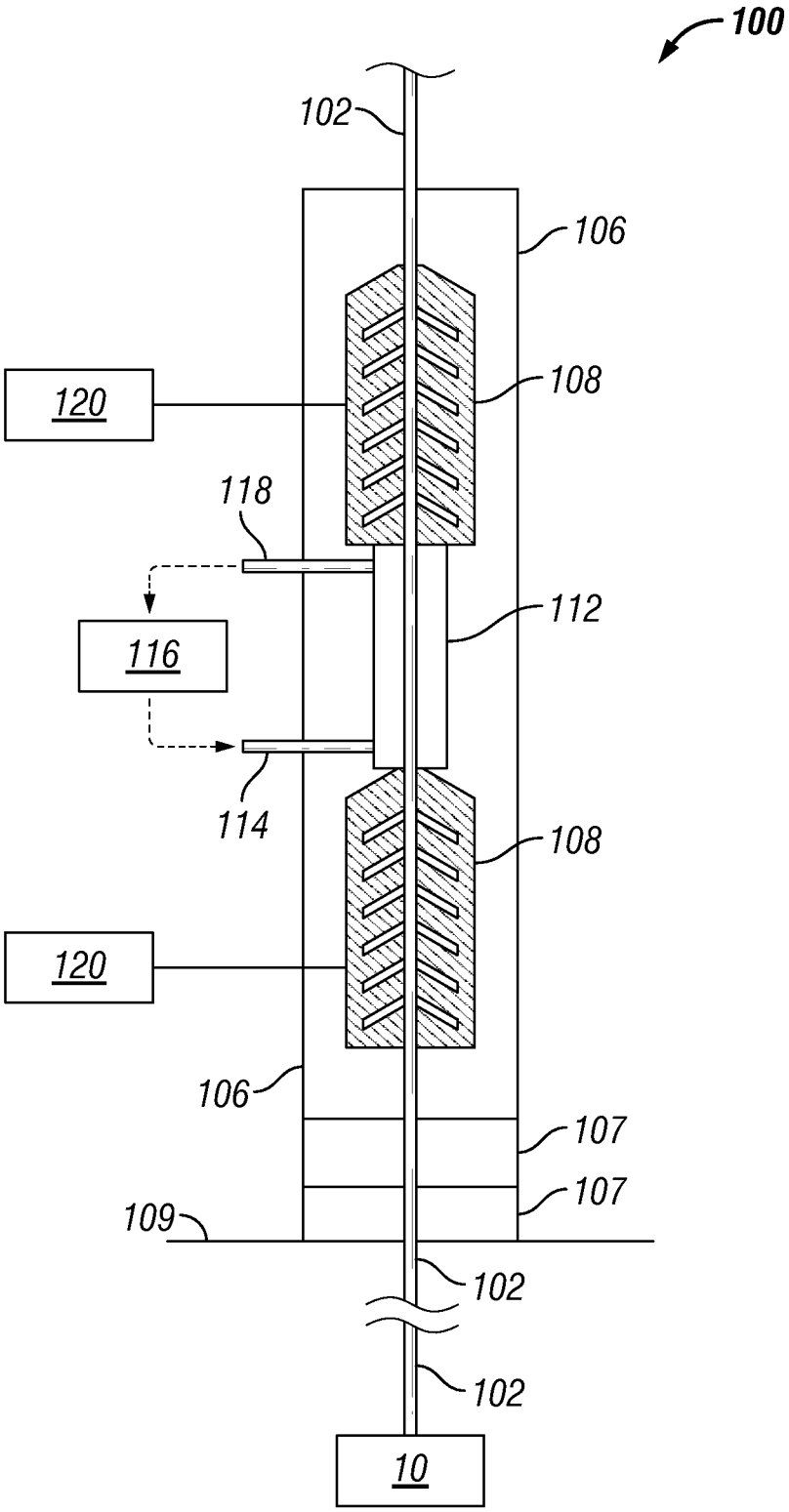
FIG. 5 is a schematic cross sectional view of an embodiment of a pressure control assembly within a wellbore.
Figure 6:
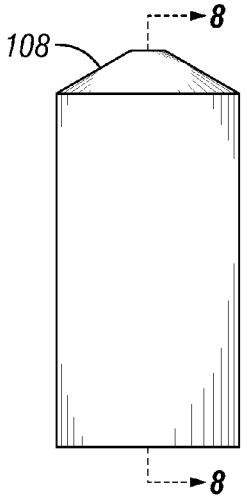
FIGS. 7 and 6 are schematic top and elevation views, respectively, of an embodiment of a line wiper.
Figure 7:
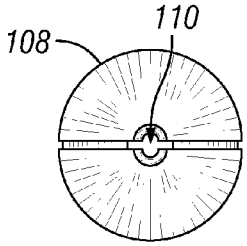

The assembly 100 further comprises at least one lubricant inlet 114 for introducing a lubricant, such as grease or any suitable lubricant, from a lubricant source 116 into the chamber 112 for lubricating and sealing the cable 102 within the chamber 112. The assembly further comprises a lubricant outlet 118 that allows lubricant from within the chamber 112 to flow back to the lubricant inlet 114, such as through the lubricant source 116, as shown in FIG. 5. The lubricant source 116, lubricant inlet 114, and lubricant outlet 118 advantageously provide for continuous grease or other lubricant injection between the line wipers 108, such as by having an input to the grease pump and/or an output just similar to a flow tube system. The lubricant source 116, lubricant inlet 114, and lubricant outlet 118 may provide just enough grease pressure between the two line wipers 108 for sealing. The lubricant from the lubricant source 116 may be injected or introduced at the lubricant inlet 114 and may exit from the lubricant outlet 118 and be discarded from the outlet 118 at the top of the assembly 100 while fresh or new lubricant or grease from the lubricant source 116 may be injected into the lubricant inlet 114.

The assembly 100 may further comprise an actuator 120 connected to each of the sealing devices or line wipers 108 to actuate the line wiper 108 to engage with an exterior surface of the cable 102. The actuator 120 may be a hydraulic actuator, a pneumatic actuator, or any suitable actuator, as will be appreciated by those skilled in the art. A single actuator 120 may actuate each line wiper 108 or each line wiper 108 may comprise an individual actuator 120, such as that shown in FIG. 5. While the cable 102 is traveling up and down through the assembly 100, lubricant or grease from the source 116 is injected at the lubricant inlet 114 near the top of the lower line wiper 108 and returned at the lubricant outlet 118 near the bottom of the top line wiper 108. The line wipers 108 and grease disposed in the chamber 112 act as a pressure barrier for the assembly 100. The grease in the chamber 112 also acts as lubrication media for the cable 102. Advantageously, a length of the chamber 112 may be selected depending upon well head pressure that the assembly 100 is required to contain. In addition, the diameter of the chamber 112 defined by the housing 106 may be varied depending on diameter of the cable 102

Figure 8:
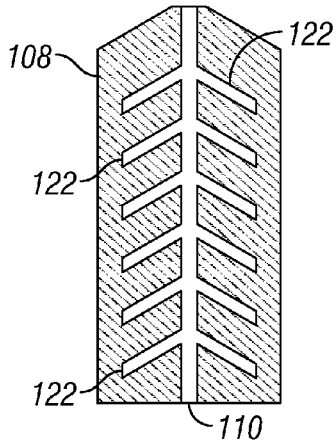
FIG. 8 is a cross sectional view taken along line 8-8 of FIG. 6.

Referring now to FIG. 8, in an embodiment, the line wipers 108 are configured with an interior chevron-shaped profile defined by internal voids 122 adjacent the cable aperture 110 to provide additional pressure relief and a more flexible, durable seal. By providing additional flow paths within the body of the line wiper 108, the internal voids 122 defined by the chevron design advantageously reduce initial well pressure prior to the pressure reaching the lubricant or grease in the chamber 112 (i.e., from the line wiper 108 disposed closer to the wellbore 10). The voids 122 may lessen any residual well pressure after the grease system (i.e., from the line wiper disposed above the chamber 112 and disposed the farthest from the wellbore 10). Additionally, the voids 122 provide the line wiper 108 with greater flexibility which may lessen the likelihood of slightly raised armor wires leading to crossover, milking or bird-caging.

Figure 9:
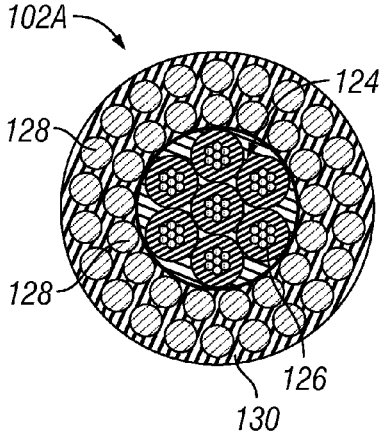
FIGS. 9 and 10 are schematic cross-sectional views, respectively, of cables for use with the pressure control assembly.
Figure 10:
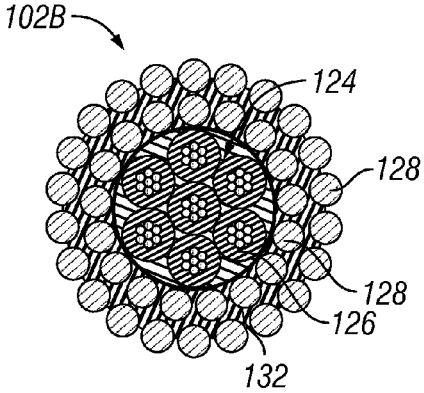

The assembly 100 may be advantageously used to seal and lubricate many types of cables 102, such as the cables 102*a* and 102*b* shown in FIGS. 9 and 10. The cables 102*a* and 102*b* each comprise a cable core 124 comprising a plurality of conductors 126 and a plurality of armor wire layers 128 surrounding the cable core 124. The cable 102*a* comprises an outer polymeric layer 130 encasing each of the layers of armor wires 128 to form a smooth outer profile, such as those shown in U.S. Pat. No. 7,170,007, incorporated herein by reference in its entirety. The cable 102*b* comprises an outer polymeric layer 132 encasing the inner layer of armor wires 128 but not the outer layer of armor wires 128. The assembly 100 may be advantageously utilized to seal and lubricate the cables 102*a* and 102*b*.

Figure 11A:
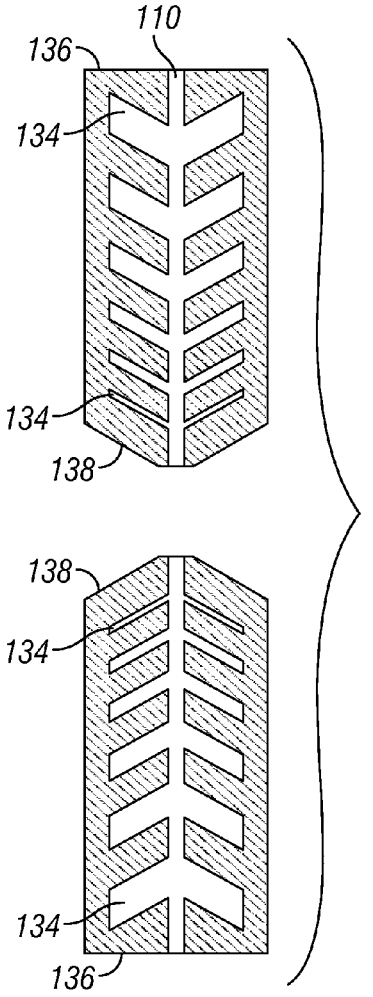
FIGS. 11*a* and 11*b* are schematic cross-sectional views, respectively, of an embodiment of a line wiper.
Figure 11B:
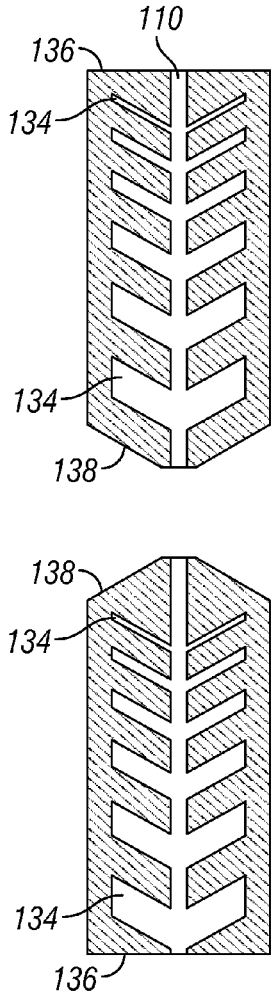
Figure 12A:
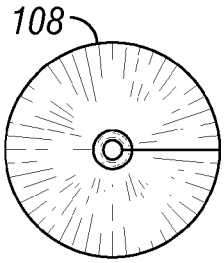
FIGS. 12*a* and 12*b* are a top view and a schematic perspective view, respectively, of an embodiment of a line wiper.
Figure 12C:
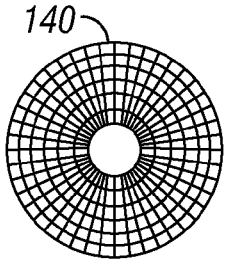
FIGS. 12*c* and 12*d* are a top view and a schematic perspective view, respectively, of an embodiment of a reinforcement member.
Figure 12B:
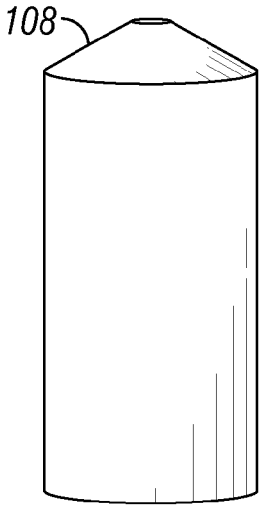
Figure 12D:
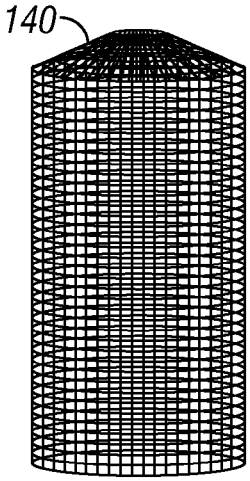
Figure 12E:
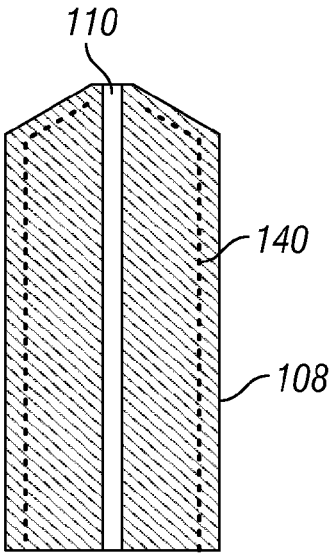
FIG. 12*e* is a cross sectional view of an embodiment of a line wiper.

In an embodiment, best seen in FIGS. 11*a* and 11*b*, the sealing devices or line wipers 108 comprise an graduated interior chevron-shaped profile defined by internal voids 134 wherein the voids 134 at an end 136 of the line wiper 108 define an area that is different than the area defined by the voids at an opposite end 138 of the line wiper 108. In FIG. 11*a*, the voids 134 at the end 136 define a greater area than the voids 134 at the opposite end 138. In FIG. 11*b*, the voids 134 at the end 138 define a greater area than the voids 134 at the opposite end 136. As also seen in FIG. 11*b*, the orientation of the chevron voids 134 may also be varied such that the chevron-shaped voids 134 extend toward one end 136 or the other end 138. Those voids 134 defining a greater area may be placed toward the bottom of the line wiper 108, where pressure is greatest. By orienting the voids 134 in a downward direction (i.e. away from the end 138), the pressure captured within the aperture 110 and the voids 134 may also be used to increase the seal against the cable 102, 102*a*, or 102*b*.

Figure 4:
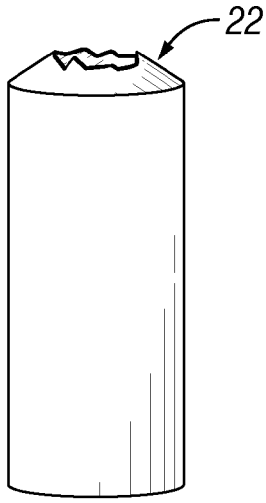
FIG. 4 (Prior Art)

In an embodiment, best seen in FIGS. 12*a*-12*e*, the sealing devices or line wipers 108 may comprise a steel reinforcement member 140 disposed therein, in a manner similar to a steel-belted tire or the like. The reinforcement member 140 provides added strength to the line wiper 108 and allows the line wiper 108 to better withstand prolonged use in the field. In particular, placing steel reinforcement in the tapered end of the line wiper helps to prevent this end from crumbling away as shown in FIG. 4. This line wiper 108 comprising the steel reinforcement member 140 may be advantageously manufactured as a monolithic body and then sliced on one side to allow it to be placed over the cable 102, 102*a*, or 102*b*, or may be manufactured as two halves that are matched together over the cable 102, 102*a*, or 102*b*. Furthermore, the steel reinforcement member 140 may be utilized with any of the line wipers shown in FIGS. 5-8, 11*a*, and 11*b*, as will be appreciated by those skilled in the art.

The combination of the sealing of the sealing devices or line wipers 108 and the injected lubricant into the chamber 112 advantageously allows the assembly 100 to maintain a predetermined pressure within the housing 106 and/or the chamber 112 between the line wipers 108. The assembly 100 may comprise at least two housing frames 106 arranged in series at the wellbore such that the cable 102 passes through each housing frame 106 prior to entering the wellbore 10. The predetermined pressure maintained by the assembly 100 may be equal to wellhead pressure, greater than wellhead pressure, less than wellhead pressure or any other suitable pressure, depending on the operational requirements of the assembly 100 and/or the cable 102, 102*a*, or 102*b*.

Figure 2:
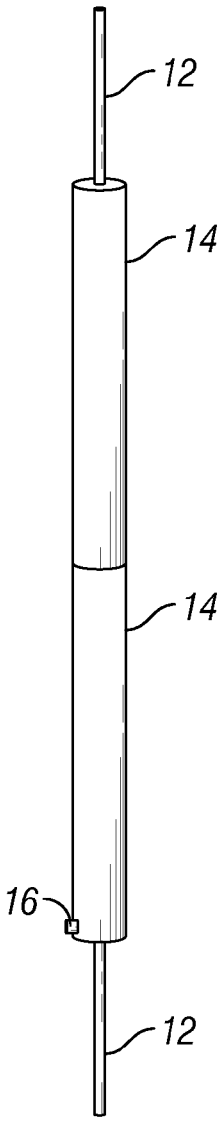
FIG. 2 (Prior Art)
Figure 3:
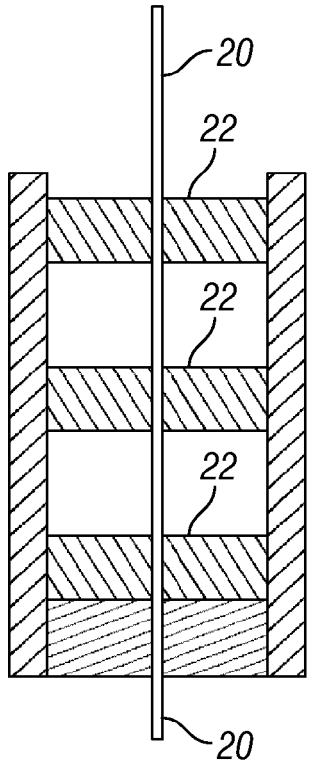
FIG. 3 (Prior Art)

The assembly 100 provides a pressure control assembly for sealing a cable 102, 102, or 102*b*, wherein tolerances between the cables 102, 102*a*, and 102*b* and the line wipers 108 may be greater than the about 0.003 to about 0.005 inches of the prior art system shown in FIGS. 1 and 2.

The assembly 100 may provide benefits such as, but not limited to, avoiding flow tubes and hence shortening wellsite surface equipment rig up height, which may save significant time during set up, pulling out of hole (POOH), and run in hole (RIH), avoiding cables getting stuck in flow tubes, such as the flow tubes 14, due to contaminants such as sand or the like on a greased cable, oversize in the cable, high armor and bird caging of the armors.

The recirculating grease-injection system of the assembly 100 advantageously provides a seal against and greatly reduces well pressure. In conjunction with the grease-pressure system, a variety of sealing or packoff devices such as "rubber" line wipers composed of different reinforced and conventional materials and with innovative internal configurations is used to remove debris from the cables and further reduce pressure. Embodiments of the assembly 100 advantageously reduce length of an uphole assembly, reduced rig up and rig down time, reduce contact friction between the cable 102, 102*a*, and 102*b* and the sealing device, enable "seal-on-demand" functionality with the use of actuators 120 and the line wipers 108, enable the cable 102, 102*a*, and 102*b* to be run in and out of the wellbore 10 faster, reduced grease consumption and may therefore be more environmentally friendly.

The line wiper 108 shown in FIGS. 5-8, and 11*a*-12*e* is preferably made of or formed from an elastomeric rubber material that has good chemical resistance, good elasticity, good abrasion resistance with low friction coefficient properties. The service temperature of the elastomeric rubber material may be from about −50 degrees Celsius to about 120 degrees Celsius. The hardness of the elastomeric rubber material may have a range of about 50 to about 90 Shore A scale (ASTM D 2240). The elastomeric rubber material may be improved to increase abrasion resistance by using various types of fillers, such as, but not limited to, carbon black, silica, nano scale of PTFE (polytetrafluoroethylene) powder, nano clay, nano carbon tube, graphite powder, brass, and molybdenum sulfide.

The elastomeric rubber material of the line wiper 108 may comprise, but is not limited to, HNBR (hydrogenated acrylonitrile butadiene copolymer rubber) available in grade name Zetpol™ from Zeon Chemical L. P. and Terban™ from Lanxess, XNBR (carboxylated acrylonitrile butadiene copolymer rubber) available in grade Nipol™ from Zeon Chemical L.P. and Terban™ XT from Lanxess., and FKM (Fluorocarbon elastomer), available under the trade under Alfa™ from Asahi Glass Co. Ltd, Viton™ from DuPont, and Technoflon™ from Solvay Solexis.

In addition, the elastomeric rubber material of the line wiper 108 may comprise use PTFE nano particle as filler into rubber to impart low surface energy. It provides improved lubricity and wear resistance. This PTFE nano particle is available under grade name Zonyl® from Du Pont.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings. Instead, the scope of the application is to be defined by the appended claims, and equivalents thereof.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. A pressure control assembly for a wireline cable disposed in a wellbore, comprising:

a housing frame having an inner bore formed therethrough;

a first line wiper concentrically located within the housing, wherein the first line wiper comprises a first solid elongated body, wherein an exterior of the first solid elongated body seals with the inner bore, wherein a first longitudinal aperture is formed through the solid elongated body, and wherein first chevron profile flow paths open from the first longitudinal aperture and terminate within the elongated body;

a second line wiper concentrically located within the housing, wherein the second line wiper comprises a first solid elongated body, wherein an exterior of the second solid elongated body seals with the inner bore, wherein a second longitudinal aperture is formed through the solid elongated body, and wherein second chevron profile flow paths open from the second longitudinal aperture and terminate within the elongated body;

a chamber formed in the housing between the line wipers, wherein the chamber is isolated at one end by the first line wiper and at the other end by the second line wiper; and an injection system in fluid communication with the cable for circulating lubricant into the housing frame and out of the housing frame, wherein the lubricant lubricates and maintains a predetermined pressure within the housing frame.

2. The pressure control assembly of claim 1, further comprising a lubrication inlet formed through the housing, wherein the lubrication inlet is located between the first line wiper and the second line wiper.

3. The pressure control assembly of claim 2, further comprising a lubrication outlet formed through the housing, wherein the lubrication outlet is located between the lubrication inlet and the first line wiper.

4. The pressure control assembly of claim 2, wherein the first elongated body and the second elongated body are made from an elastomeric material.

5. The pressure control assembly of claim 4, wherein the first elongated body comprises a first reinforcement member, and the second elongated body comprises a second reinforcement member.

6. A pressure control assembly for a wireline cable disposed in a wellbore, comprising:

a housing frame having an inner bore formed therethrough;

a first line wiper concentrically located within the housing, wherein the first line wiper comprises a first solid elongated body, wherein an exterior of the first solid elongated body seals with the inner bore, wherein a first longitudinal aperture is formed through the solid elongated body, and wherein first chevron profile flow paths open from the first longitudinal aperture and terminate within the first elongated body;

a second line wiper concentrically located within the housing, wherein the second line wiper comprises a first solid elongated body, wherein an exterior of the second solid elongated body seals with the inner bore, wherein a second longitudinal aperture is formed through the solid elongated body, and wherein second chevron profile flow paths open from the second longitudinal aperture and terminate within the second elongated body;

a chamber formed in the housing between the line wipers, wherein the chamber is isolated at one end by the first line wiper and at the other end by the second line wiper;

a lubricant inlet formed through the housing, wherein the lubricant inlet is located between the line wipers;

a lubricant outlet formed through the housing and located between the first line wiper and the lubricant inlet; and a lubrication system in communication with the lubricant inlet and lubricant outlet, wherein the lubrication system injects lubrication into and circulates lubricant out of the housing, wherein the lubricant lubricates and maintains a predetermined pressure within the housing frame.

7. The pressure control assembly of claim 6, wherein the first elongated body and the second elongated body are made from an elastomeric material.

8. The pressure control assembly of claim 6, wherein the first elongated body comprises a first reinforcement member, and the second elongated body comprises a second reinforcement member.

* * * * *